United States Patent [19]

Studer, Jr. et al.

[11] Patent Number: 4,882,592

[45] Date of Patent: Nov. 21, 1989

[54] MOTOR VEHICLE ANTENNA MOUNT

[75] Inventors: S. Nicholas Studer, Jr., Manalapan; Kevin J. Connolly, Freehold, both of N.J.

[73] Assignee: Radio Frequency Systems, Inc., Marlboro, N.J.

[21] Appl. No.: 306,521

[22] Filed: Feb. 3, 1989

[51] Int. Cl.[4] ..... H01Q 1/32

[52] U.S. Cl. ..... 343/715; 343/900

[58] Field of Search ..... 343/711, 712, 713, 715, 343/850, 900, 872

[56] References Cited

U.S. PATENT DOCUMENTS

| | | | |
|---|---|---|---|
| 4,089,817 | 5/1978 | Kirkendall | 343/850 |
| 4,218,684 | 8/1980 | Northcutt | 343/715 |
| 4,266,227 | 5/1981 | Blaese | 343/715 |
| 4,779,098 | 10/1988 | Blaese | 343/715 |
| 4,785,305 | 11/1988 | Shyu | 343/715 |
| 4,794,319 | 12/1988 | Shimazaki | 343/715 |

OTHER PUBLICATIONS

Installation Instructions from The Antenna Specialists Co. for "On-Glass" ® Antenna for 138-158 MHz or 150-174 MHz, 7-88.

*Primary Examiner*—Rolf Hille
*Assistant Examiner*—Doris J. Johnson
*Attorney, Agent, or Firm*—Watts, Hoffmann, Fisher & Heinke

[57] ABSTRACT

An antenna base having a metal foot and plastic bezel injection molded around the metal foot to engage the metal foot. Double sided adhesive tape connects the antenna base to a non-conductive surface of a motor vehicle. In most instances this is a motor vehicle windshield. Inside the motor vehicle a coupling box connects communications signals from a signal source through the windshield to the metal foot. The coupling box supports a printed circuit board having conductive patterns on both sides for sending and receiving these communications signals. The metal foot also includes structure that allows an elongated antenna to be adjustably supported by the base in a signal sending and receiving orientation.

19 Claims, 3 Drawing Sheets

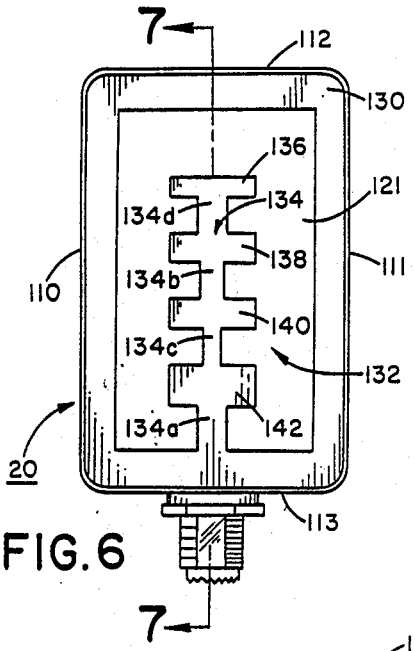
FIG.6
FIG.7
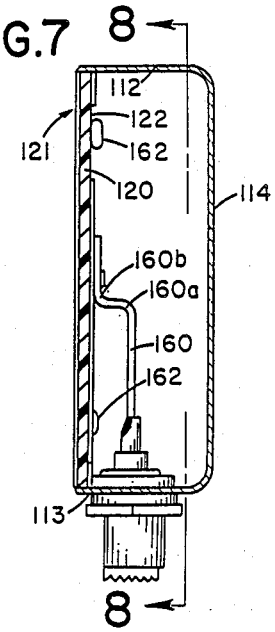
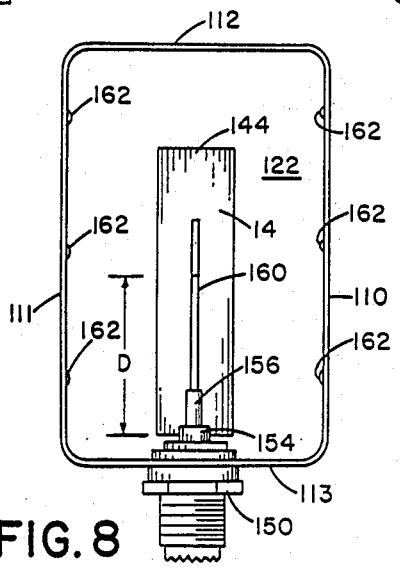
FIG.8

MOTOR VEHICLE ANTENNA MOUNT

TECHNICAL FIELD

The present invention concerns mounting structure and signal transmission for a mobile communications antenna.

BACKGROUND ART

Techniques for transmitting mobile communication signals through vehicle windshields have been adopted in the recent past. This is particularly true with the advent of cellular telephones for use in mobile communications. Two prior art U.S. patents relating to through-the-glass coupling form mobile communications systems are Kirkendall U.S. Pat. No. 4,089,817 and Blaese U.S. Pat. No. 4,658,259. In each of these systems, an elongated antenna is mounted to a windshield or other non-conducting vehicle portion and signals are sent and received through the motor vehicle windshield using impedance matching techniques disclosed in those prior art patents.

U.S. Pat. No. 4,474,353 Martino et al. discloses a technique for mounting an elongated antenna to a windshield. In accordance with the disclosure of this patent, a piece of double sided tape is used to hold an antenna base in place and the engagement between the double sided tape and the windshield is protected by a silicone material which shields the double sided tape from contact with moisture which otherwise would degrade the adhesion.

The use of the double sided tape in the aforementioned patent reduces the incidence of cracking of the windshield due to different coefficients of expansion of cements used in the prior art for gluing the antenna mount to the windshield. While avoiding the windshield cracking problem, the use of the double sided tape required application of a silicone protective layer around the outer perimeter of the tape to avoid degradation of the adhesion as moisture contacted the double sided tape. The resultant antenna mounting technique disclosed in the '353 patent is a multiple step process involving overlying portions of the mount and application of silicone around the outer periphery of the mount to avoid weakening of the adhesion.

DISCLOSURE OF THE INVENTION

One aspect of the present invention is an antenna mount constructed using a monolithic base which avoids the multiple step installation process associated with the prior art. A monolithic base constructed in accordance with the invention includes a metal foot and surrounding plastic shield or bezel which engages the metal foot. The base is affixed to the windshield with the use of a single piece of double sided tape. Subsequent to this mounting step, an elongated whip antenna can be attached to the base and oriented in a communications transmitting and receiving position.

On an inside portion of the windshield, a communications coupling box having an etched circuit board affixed in juxtaposition to the base by fixing the coupling box to the windshield with a second piece of double sided tape. Due to the novel arrangement of the conductive circuit patterns and arrangement for energizing those patterns no tuning device such as a variable tuned capacitive circuit is needed to impedance match signals transmitted through the coupling box.

The etched circuit board on the inside of the windshield and the metal foot of the base are approximately the same dimension and are aligned to provide good communication coupling between a transceiver mounted within the motor vehicle and the elongated antenna mounted outside the vehicle. The alignment is achieved by first applying the coupling box to the inside of the windshield and then mounting the antenna base to the outside of the windshield by visually aligning it with the coupling box inside the vehicle. Experience with the disclosed antenna mount indicates some margin of error exists in the precision with which the coupling box and base align.

The preferred metal foot and non-conductive shield engage along an outer periphery of the metal foot. More specifically, the foot is molded and a plastic shield then molded around the outer periphery of the foot so that a bottom surface of the shield and a bottom surface of the metal foot are coplanar. The metal foot includes a groove extending around its outer periphery into which the plastic flows during the molding process. Preferably, the plastic shield is injection molded in a specially configured mold having an opening to accommodate a stem portion of the metal foot. Subsequent to this molding process, the metal foot and shield are withdrawn from the mold as a single monolithic antenna base. This base is then ready for mounting to the windshield by the use of the double sided tape.

From the above it is appreciated that one object of the present invention is an antenna mount for use in mobile communications applications having a metal base and integral shield constructed to form a single unit which can be readily applied to the windshield or other nonconducting motor vehicle portion. This and other objects, advantages and features of the invention will become better understood from a detailed description of the invention described in conjunction with the accompanying drawings.

BRIEF DESCRIPTION OF THE DRAWINGS

FIG. 6 is a plan view of a coupling box mounted inside the motor vehicle for transmitting communications signals to and from the antenna of FIG. 1;

FIG. 7 is a section view as seen from the plane defined by the line 7—7 in FIG. 6; and FIG. 8 is a view of the coupling box as seen from the plane 8—8 of FIG. 7.

BEST MODE FOR CARRYING OUT THE INVENTION

Figure 1:
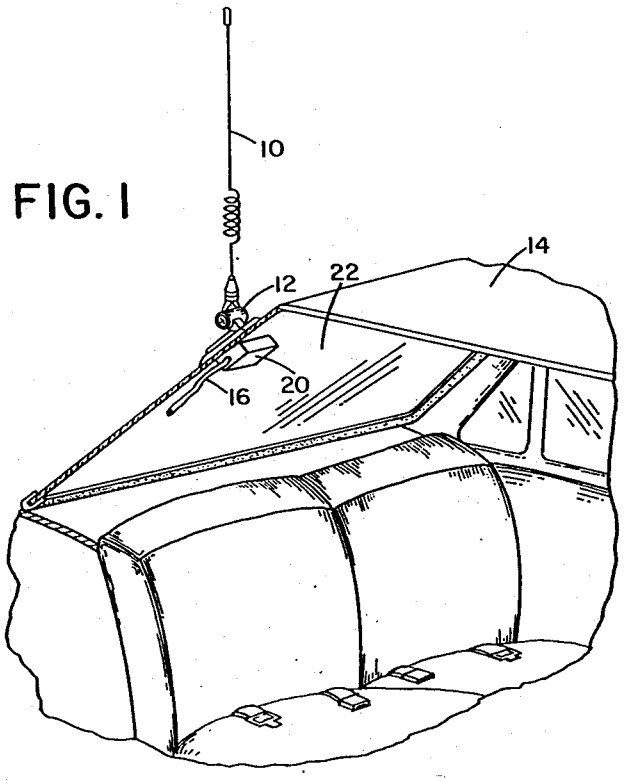
FIG. 1 is a perspective view showing one use of a mobile communications antenna mounted to a rear windshield of a motor vehicle.

Turning now to the drawings, a mobile communications antenna 10 supported by a base 12 is depicted schematically in FIG. 1. One use for such a communications antenna 10 is for use with a cellular telephone mounted within a motor vehicle 14.

Communication signals from the cellular phone (not shown) to the antenna 10 are carried by an electrically conductive signal carrying cable 16 which is routed to a coupling box 20 positioned inside the motor vehicle on an interior surface of a glass windshield 22. In a manner described more completely below, these signals are transmitted through the windshield 22 to the base 12 and antenna 10. The particular windshield 22 depicted in FIG. 1 is a rear windshield 22 which often includes defroster wires extending horizontally across its width. The base 12 is positioned equidistant between these wires so that electrical interference between the defroster wires and the antenna base is minimized.

The base 12 is also depicted in the enlarged views of the remaining figures where the mount is seen to include a metal foot 30 having an elongated stem portion 32 extending perpendicularly away from the glass windshield 22. A threaded opening 34 extends through the stem portion 32 to allow the antenna 10 to be mounted to the stem portion 32.

The antenna 10 is constructed from stainless steel wire having first elongated portion 40, an intermediate coil 41 and a second elongated portion 42. The dimensions of these elongated portions are designed to accept communication signals of a particular wavelength. At one end of the antenna an antenna adapter 43 couples the antenna 10 to a swivel base 44. The base is mounted to the stem portion 32 of the foot 30 by means of a threaded connector 46 passing through the swivel mount 44 to engage the threaded opening 34 of the stem 32. To properly orient the antenna, the connector 46 can be loosened to allow the base 44 to be pivoted about a pivot axis passing through a center of the opening 34. When an appropriate orientation of the antenna 10 has been achieved the connector 46 is tightened to securely position the antenna in this orientation.

Figure 5:
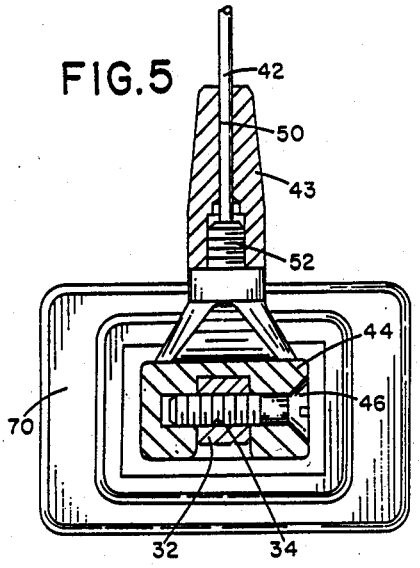
FIG. 5 is a section view as seen from the plane 5—5 in FIG. 3.
Figure 2:
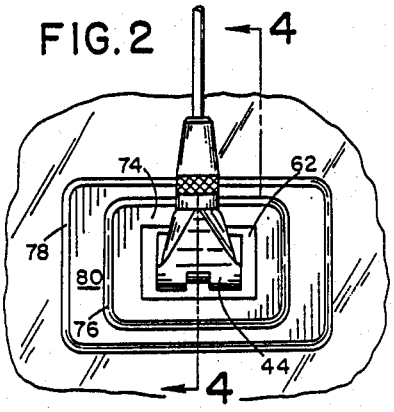
FIG. 2 is a plan view of a portion of the antenna and a mounting structure for that antenna.
Figure 3:
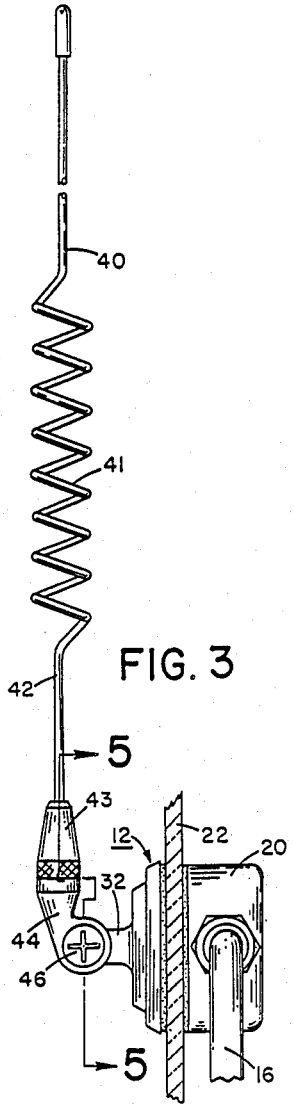
FIG. 3 is a elevation view of a mobile communications antenna mounted to a windshield and including a coupling box for routing communication signals to and from the antenna.

As seen most clearly in FIG. 5, the antenna adapter 43 defines a bore 50 which leads to a threaded cavity 51 in the adapter 43 that engages a threaded stud 52 connected to the swivel base 44. The elongated portion 42 of the antenna 10 is inserted into the adapter and pushed through the bore 50. The adapter is screwed onto the swivel base 44 until the stud 52 engages the antenna portion 42.

Figure 4:
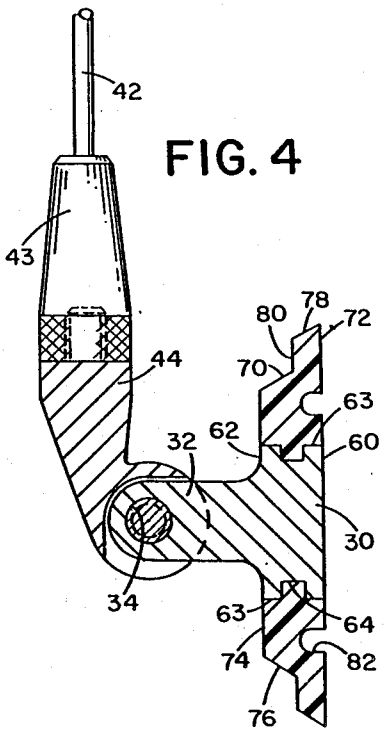
FIG. 4 is a section view of the antenna mount as seen from the plane 4—4 of FIG. 2.

The metal foot 30 has an enlarged portion which defines a planar surface 60 (FIG. 4) conforming generally to the surface of the windshield 22. A surface 62 of the metal foot 30 that faces away from the windshield 22 has the same length and width dimensions as the inner surface 60 but is disrupted by the metal stem 32 at a location generally centered within the surface 62.

The metal foot 30 defines four sides 63 having a notch or groove 64 extending around the outer perimeter of the foot 30. A plastic bezel 70 completely surrounds the sides 63 of the metal foot 30 and includes an inwardly facing surface 72 which is substantially coplanar with the surface 60 of the metal foot 30. An outwardly facing surface 74 is substantially coplanar with the top surface 62 of the metal foot 30. First and second beveled surfaces 76, 78 are separated by a intermediate planar stepped surface 80 which is generally parallel to the surfaces 72, 74.

Construction of the mount 18 starts with provision of a metal foot 30 that includes the stem 32 and also has the groove 64 formed in the sides 63. The metal foot is preferably constructed by molding using a powdered metal molding technique. The base fabrication process continues by placing the metal foot 30 in a mold and injection molding a plastic (ABS plastic is preferred) into the mold to form the plastic bezel 70. A preferred mold has a cavity or depression to accommodate the metal stem portion 32 of the foot 30. Plastic flows into the groove 64 in the outer periphery of the foot 30 and solidifies within the groove to form a monolithic base 12 of both the foot 30 and bezel 70.

The metal foot 30 exhibits electrical characteristics suitable for communications signal transmission from inside the windshield 22 through the foot 30 to the swivel mount 44, whip adapter 42 and antenna 10. The bezel 70 rigidly adheres to the base 30 and facilitates positioning of the mount 18 on the windshield. The mold used to fabricate the bezel 70 has structure that forms a groove 82 in the inwardly facing surface 72 which surrounds the metal foot 30. This groove 82 allows the plastic bezel 70 to better accommodate stress forces due to expansion and contraction with temperature.

FIGS. 6–8 illustrate details concerning the coupling box 20 for transmitting communication signals from inside the motor vehicle 14 to the metal foot 30. The coupling box 20 defines an elongated housing preferably constructed of tin-plated steel having side walls 110, 111 and end walls 112, 113. A base 114 of the coupler box 20 faces inwardly away from the windshield 22 and defines a surface generally parallel to the planar surface of the windshield 22.

The coupling box 20 supports a generally rectangular fiberglass printed circuit board 120 having metallic patterns defined (preferably by etching) on an outwardly facing surface 121 as well as an inwardly facing surface 122. On the outer surface 121, a conductive pattern includes a rectangular perimeter portion 130 having a width of approximately 3/16 inch and an elongated metal pattern 132 connected to the perimeter portion 130 near the end 113 wall of the coupling box 20. The pattern 132 includes a center section 134 extending a length of 1 9/16 inches from where the pattern 132 meets the perimeter portion to its end. Perpendicularly extending cross pieces 136, 138, 140, and 142 each have a length of approximately ½ inch. The widths of the crosspieces 136, 138, 140, 142 are ⅛, 3/16, 3/16 and ¼ inches, respectively. The center portion 134 varies in width along the length of the pattern 132. More specifically, two relatively wide portions **134*a*, 134*d* are approximately the same width (3/16 inch). These two portions 134*a*, 134*d* are separated by a segment 134*c* slightly less than ⅛ inch wide and a slightly wider portion 134*b*** having a width of about ⅛ inch.

Turning to FIGS. 7 and 8, spaced from the pattern 132 on an opposite side 122 of the printed circuit board 120 is a second conductive pattern 144 which is generally rectangular and has a length of 1 and 43/64 inches and a width approximately the same width (i.e., 3/16 inch) as the cross members 136, 138, 140, and 142.

An electrical bulkhead connector 150, commercially available from R.F. Industries under part No. RFU-602-1, is attached to the coupler 20 and includes a connector body which passes through an opening in the coupler wall 113. The connector 150 is a conventional 50 ohm impedance connector to impedance match with a 50 ohm cable 16 from the signal transceiver. The connector 150 includes an insulator 154 for spacing a center signal carrying conductor from an outer housing of the connector. A metallic connector contact 156 extends through the insulator 154 and is maintained in electrical engagement with a signal carrying center conductor of the cable 16. The outer sheath of the cable 16 is grounded and is in electrical engagement with the connector body which in turn is electrically connected to the metallic coupling box 20.

An elongated conductor 160 is soldered to the contact 156 at one end and soldered to the rectangular conductive pattern 140 at an opposite end. During fabrication of the coupler 20 the connector 150 is routed through a suitably dimensioned opening in the end wall 113 from inside the coupler with the conductor 160 already attached to the conductive pattern 140. The walls 110, 111 have small indentations 162 which extend inwardly into the coupling box. Once the connector 150 is pushed through the opening in the wall 113 the printed circuit board 120 is pushed into the box 20 until the surface 122 engages these indentations 162. The printed circuit board is then soldered to the coupling box 20 by applying a band of solder around the perimeter portion 130 of the conductive pattern.

The dimensions of the conductive patterns 132, 144 on the printed circuit board 120 achieve a broadband impedance match for communications signals passing through the coupling box 20. In the preferred and disclosed embodiment of the invention the conductor has a round diameter of 0.050 inches and is bent to include two right angle bends **160*a*,60*b* so the distance D (FIG. 8) between the end of the pattern 144 and the point of contact between conductor 160 and pattern 144 is 1 1/16 inches. When properly positioned relative the antenna base 12 the coupling box 20 provides a broadband impedance match in the 800 Mhertz to 900 Mhertz frequency range. Approximately 90% of the power from the car transceiver reaches the antenna 10. Due to the construction of the conductive patterns 132, 144 and the location at which the conductor 160 contacts the pattern 144 the coupling box needs no tuning device such as a variable capacitor to impedance match signals transmitted to the antenna 10**.

Both the base 12 and coupling box 20 are mounted to the windshield with double sided tape that is commercially available from 3M Industrial Specialties Division, St. Paul, Minn. 55144. The coupling box has a width of approximately 1½ inches, a length of approximately 2⅜ inches and a depth of approximately 11/16 inches. The bezel 70 has a width of 1⅝ inches and a length of 2 7/16 inches and is therefore slightly larger than the coupling box. The bezel is approximately ¼ inch thick between the two surfaces 72, 74. The metal foot 30 has a length of approximately 1 1/16 inch and a width of approximately ⅝ inch.

The present invention has been described with a degree of particularity. Modifications from the disclosed embodiment of the invention can be made, but it is the intent that the invention include all such modifications and alterations falling within the spirit and scope of the appended claims.

We claim:

1. Apparatus for communicating signals through a motor vehicle window comprising:

(a) a base including:

(i) a metal foot having an exposed antenna support portion for supporting an antenna in a signal receiving or transmitting orientation and an additional portion having a base surface conforming generally to a surface contour of an outer surface of the motor vehicle window; said additional portion also defining an outer periphery having a groove extending around at least a portion of said outer periphery;

(ii) a non-metallic shield engaging the outer periphery of the metal foot and extending into the groove to engage and adhere to said metal foot, said shield having a window conforming surface generally co-planar with the base surface of the metal foot;

(b) an adhesive material having one adhesive surface dimensioned to engage both the base surface of said foot and the window conforming surface of the shield and having a second adhesive surface to engage the motor vehicle window to affix the shield and metal foot to the window; and (c) an elongated communications antenna coupled to a swivel base that adjustably engages the antenna support portion of the metal foot to allow the antenna to be re-oriented.

2. The apparatus of claim 1 additionally comprising a signal transmitting and receiving device mounted to an inside surface of the motor vehicle window, said signal transmitting and receiving device including a metal pattern generally aligned with the base surface of the metal foot to couple signals to and from the antenna with a communications device positioned inside the motor vehicle.

3. The apparatus of claim 2 wherein the signal transmitting and receiving device includes a flat electrically insulating member supporting the metal pattern on one surface and including a electrically conductive band on an opposite surface for transmitting and receiving signals to and from the communications device.

4. The apparatus of claim 3 wherein the metal pattern includes an elongated center section having crosspieces that extend away from the elongated center section on either side and wherein one end of the elongated center section is electrically coupled to a perimeter conductor about an outer region of the electrically insulating member.

5. A base for supporting a communications antenna in a signal sending and receiving orientation on a non-conductive surface of a motor vehicle comprising:

a metal foot having an elongated stem portion with a hole passing therethrough to allow adjustable engagement between said stem portion and the antenna; said foot including a base portion integral with the stem portion that includes an base surface generally conforming to the non-conductive surface of the motor vehicle and a perimeter surface having a groove therein extending into said base portion of the metal foot; and a plastic shield which covers the perimeter surface of the foot and extends into the groove therein to adhere to the metal foot, said plastic shield having a generally planar foot surrounding surface co-planar with the base surface of said metal foot and conforming to the non-conductive surface of the motor vehicle.

6. The base of claim 5 wherein the perimeter surface of the metal foot is four sided.

7. Apparatus for transmitting communications signals through a motor vehicle windshield comprising:

(a) a metal foot having an antenna support portion for supporting an antenna in a signal transceiving orientation and a windshield engaging portion having a base surface conforming generally to an outside surface of the windshield;

(b) a non-conductive shield engaging and adhering to the metal foot, said non-conductive shield having a surface generally co-planar with the base surface of the metal foot to engage the outside surface of the windshield;

(c) adhesive means for affixing the shield and metal foot to the windshield;

(d) signal transceiver means adapted for mounting to an inside surface of the windshield including a planar insulating support having one side that supports a first conductive pattern including an elongated center section from which extend a plurality of crosspieces facing the metal foot through the windshield and an opposite side that supports a second generally rectangular conductive pattern spaced from the first conductive pattern by a width of the planar insulating support and in alignment with and having approximately the same width as the crosspieces of the first metal pattern; and (e) transmission means electrically coupled to the second conductive pattern to convey signals to and from a transceiver positioned inside the motor vehicle;

(f) said signal transceiver means tuned for a signal frequency range without use of adjustable tuning elements.

8. The apparatus of claim 7 wherein the signal transceiver means comprises a metal enclosure supporting the planar insulating support in generally parallel alignment with the windshield and wherein the transmission means comprises an electrical connector passing through a wall of the metal enclosure; said electrical connector having a center contact electrically coupled to said second generally rectangular conductive pattern.

9. The apparatus of claim 8 wherein the metal enclosure is grounded by a signal carrying conductor connected to the electrical connector.

10. The apparatus of claim 9 wherein the planar insulating support also supports a perimeter conductive pattern in electrical contact with the grounded metal enclosure, said perimeter metal pattern electrically connected to the first metal pattern at one end of the first metal pattern.

11. The apparatus of claim 8 wherein the metal enclosure and planar insulating support are coupled to the windshield with double sided adhesive tape.

12. The apparatus of claim 7 additionally comprising an elongated communications antenna and a swivel base attached to the antenna support portion of the metal foot.

13. Apparatus for mounting an antenna on an electrically non-conductive surface of a motor vehicle comprising:

(a) a metal foot having an antenna support portion for supporting the antenna in a signal receiving or transmitting orientation and a surface engaging portion having a base surface conforming generally to a surface contour of the non-conductive surface of the motor vehicle; said surface engaging portion having a circumferential groove extending around at least a portion of an exposed metal foot surface;

(b) a non-conductive shield engaging the exposed metal foot surface and entering the circumferential groove to adhere to said metal foot, said non-conductive shield having a flat surface generally co-planar with the base surface of the metal foot;

(c) an adhesive material having one adhesive surface dimensioned to engage both the base surface of said foot and the flat surface of the shield and having a second adhesive surface to engage the non-conductive surface of said motor vehicle and thereby affix the shield and metal foot to the non-conductive surface; and (d) a signal transmitting and receiving device mounted to an inside surface of the motor vehicle, said device including a flat electrically insulating member supporting a metal pattern generally aligned with the metal foot of said antenna mount on one surface and including an electrically conductive band on an opposite surface to couple signals to and from the antenna with a communications device positioned inside the motor vehicle.

14. The apparatus of claim 13 wherein the metal pattern includes an elongated center section having crosspieces that extend away from the elongated center section on either side and wherein one end of the elongated center section is electrically coupled to a perimeter conductor about an outer region of the electrically insulating member.

15. Apparatus for communicating signals through an electrically non-conductive component of a motor vehicle comprising:

(a) an elongated communications antenna supported by an antenna base for mounting the antenna; said antenna base including:

(i) a metal foot having an antenna support portion for supporting the elongated antenna in a signal receiving or transmitting orientation and an additional portion having a base surface conforming generally to an outside surface of the non-conductive component of the motor vehicle; said additional portion having a groove extending into an outer periphery the metal foot; and (ii) a non-metallic shield engaging the outer periphery of the metal foot and extending into the groove to engage and adhere to said metal foot, said shield having a support surface generally co-planar with and surrounding the base surface of the metal foot; and (b) an adhesive material for coupling the base surface of said foot and the support surface of the shield to the non-conductive component of said motor vehicle to affix the shield and metal foot to the outside surface.

16. The apparatus of claim 15 wherein the outer periphery of the metal foot has multiple elongated sides into which the groove extends and wherein the shield overlies at least a portion of each of the multiple elongated sides and extends into the groove to couple the shield and metal foot together to form the base antenna.

17. The apparatus of claim 15 wherein the antenna support portion comprises a stem having an aperture therethrough and additionally comprising a swivel base coupled to the elongated antenna that engages the stem and can be rotated about an axis passing through the aperture to re-orient the antenna.

18. The apparatus of claim 15 wherein the adhesive material is double side adhesive tape.

19. The apparatus of claim 15 additionally comprising a signal transmitting and receiving device mounted to an inside surface of the motor vehicle, said signal transmitting and receiving device including a metal pattern generally aligned with the base surface of the metal foot to couple signals to and from the elongated communications antenna with a transceiver positioned inside the motor vehicle.

* * * * *